US010150287B2

(12) United States Patent
Ogawa et al.

(10) Patent No.: US 10,150,287 B2
(45) Date of Patent: Dec. 11, 2018

(54) CONVEYING DEVICE AND PRINTING APPARATUS

(71) Applicants: Masato Ogawa, Kanagawa (JP); Kohki Asada, Tokyo (JP)

(72) Inventors: Masato Ogawa, Kanagawa (JP); Kohki Asada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/598,839

(22) Filed: May 18, 2017

(65) Prior Publication Data

US 2017/0334218 A1 Nov. 23, 2017

(30) Foreign Application Priority Data

May 20, 2016 (JP) ..... 2016-101642
Apr. 7, 2017 (JP) ..... 2017-077091

(51) Int. Cl.
*B41J 11/00* (2006.01)
*B41J 2/01* (2006.01)
*B41J 13/08* (2006.01)

(52) U.S. Cl.
CPC ..... *B41J 2/01* (2013.01); *B41J 11/002* (2013.01); *B41J 11/007* (2013.01); *B41J 11/0015* (2013.01); *B41J 13/08* (2013.01)

(58) Field of Classification Search
CPC ... B41J 2/01; B41J 13/08; B41J 11/007; B41J 11/002; B41J 11/0015
See application file for complete search history.

(56) References Cited

U.S. PATENT DOCUMENTS 5,081,502 A * 1/1992 Mitsuya ..... G03G 15/201 399/336
5,407,191 A * 4/1995 Ukai ..... B65H 43/00 271/202
5,812,153 A * 9/1998 Watanabe ..... B41J 2/04 347/3
5,815,763 A * 9/1998 Todoki ..... G03D 15/022 396/618
2010/0053239 A1* 3/2010 Furukawa ..... B41J 2/14233 347/6
2010/0103237 A1* 4/2010 Hara ..... B41J 3/543 347/102

FOREIGN PATENT DOCUMENTS

JP 6-278276 10/1994
JP 7-314820 12/1995
JP 2000-203001 7/2000
JP 2007-155908 6/2007
JP 2014-181130 9/2014

* cited by examiner

*Primary Examiner* — Yaovi M Ameh
(74) *Attorney, Agent, or Firm* — Oblon, McClelland, Maier & Neustadt, L.L.P.

(57) ABSTRACT

A conveying device includes a blower, a wind-permeable sheet material supporter, and a conveyor. The blower blows air toward a sheet material. The sheet material supporter supports a center region of the sheet material from a back side of a blown surface of the sheet material. The conveyor conveys the sheet material through a blowing region blown by the blower, while sandwiching an end region of the sheet material in a sheet-material width direction perpendicular to a sheet-material conveyance direction in which the sheet material is conveyed by the conveyor.

7 Claims, 11 Drawing Sheets

CONVEYING DEVICE AND PRINTING APPARATUS

CROSS-REFERENCE TO RELATED APPLICATIONS

This patent application is based on and claims priority pursuant to 35 U.S.C. § 119(a) to Japanese Patent Application Nos. 2016-101642, filed on May 20, 2016, and 2017-077091, filed on Apr. 7, 2017 in the Japan Patent Office, the entire disclosure of each of which is hereby incorporated by reference herein.

BACKGROUND

Technical Field

Embodiments of the present disclosure relate to a conveying device and a printing apparatus.

Related Art

A printing apparatus includes, for example, a conveying device to blow air toward a sheet material to dry a substance adhered to the sheet material.

SUMMARY

In an aspect of the present disclosure, there is provided a conveying device that includes a blower, a wind-permeable sheet material supporter, and a conveyor. The blower blows air toward a sheet material. The sheet material supporter supports a center region of the sheet material from a back side of a blown surface of the sheet material. The conveyor conveys the sheet material through a blowing region blown by the blower, while sandwiching an end region of the sheet material in a sheet-material width direction perpendicular to a sheet-material conveyance direction in which the sheet material is conveyed by the conveyor.

In another aspect of the present disclosure, there is provided a printing apparatus that includes a liquid discharger and the conveying device. The liquid discharger discharges liquid onto a sheet material. The conveying device blows air toward and conveys the sheet material to which the liquid discharged by the liquid discharger has adhered.

In still another aspect of the present disclosure, there is provided a printing apparatus that includes a liquid discharger, a pre-processing unit, and the conveying device. The liquid discharger discharges liquid to a sheet material. The pre-processing unit is disposed upstream from the liquid discharger in the sheet-material conveyance direction, to apply a treatment liquid to the sheet material before the liquid is discharged. The conveying device blows air toward and conveys the sheet material to which the treatment liquid is applied by the pre-processing unit.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
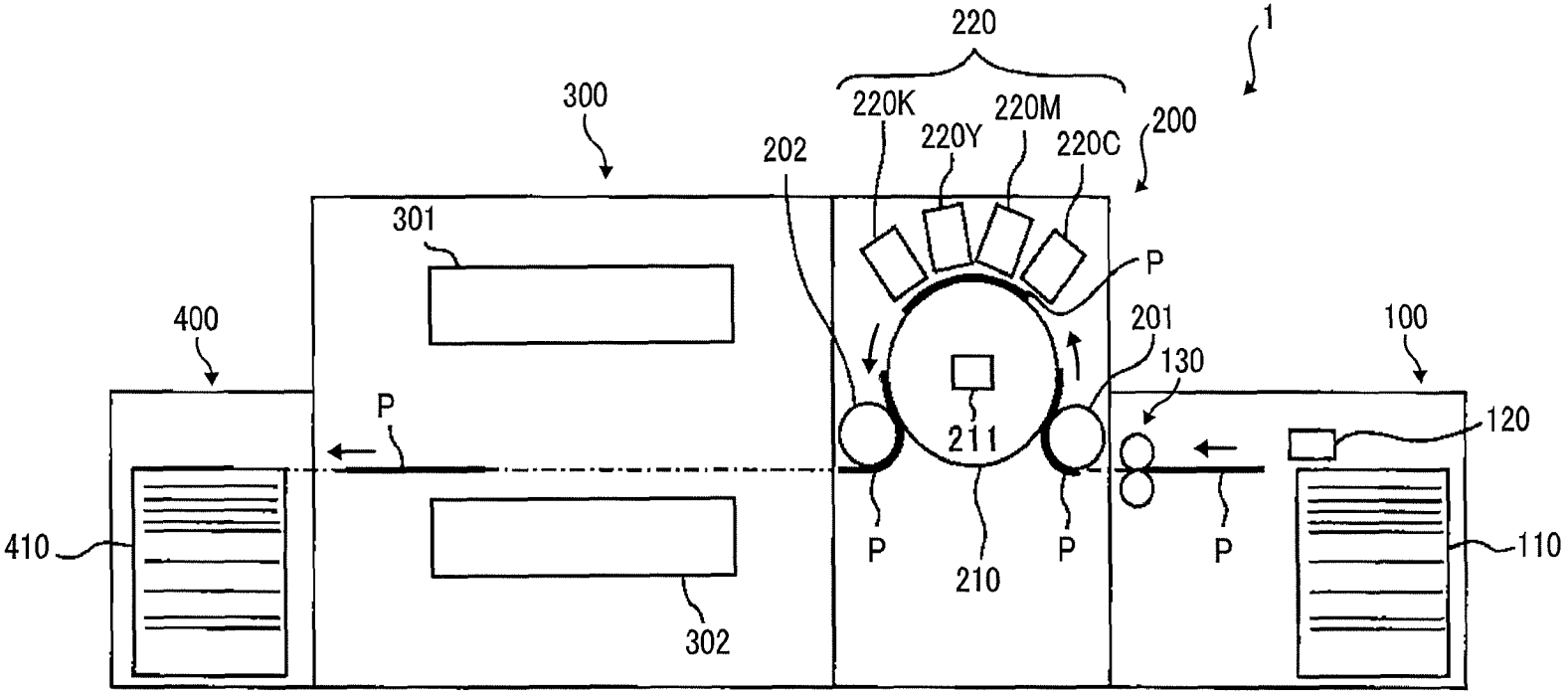
FIG. 1 is a schematic view of a configuration of an inkjet recording apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, embodiments of the present disclosure are described with reference to the drawings.

Overall description FIG. 1 is a schematic view of a configuration of an inkjet recording apparatus according to an embodiment of the present disclosure. An inkjet recording apparatus 1 according to the present embodiment includes, for example, a sheet feeding unit 100, an image forming unit 200, a drying unit 300, and a sheet ejection unit 400. In the inkjet recording apparatus 1, an image is formed on the sheet P, which is a recording material as a sheet material fed from the sheet feeding unit 100, with ink that is a liquid for image formation in the image forming unit 200. After the ink adhered to the sheet is dried in the drying unit 300, the sheet is ejected from the sheet ejection unit 400.

Sheet feeding unit The sheet feeding unit 100 includes, for example, a sheet feed tray 110 on which a plurality of sheets P is stacked, a sheet feeder 120 to separate and feed the sheets P one by one from the sheet feed tray 110, and paired registration rollers 130 to send the sheet P to the image forming unit 200. As the sheet feeder 120, any sheet feeder, such as a device using rollers or a device using air suction, can be used. After the leading end of the sheet fed from the sheet feed tray 110 by the sheet feeder 120 reaches the paired registration rollers 130, the paired registration rollers 130 are driven at a predetermined timing to feed the sheet to the image forming unit 200. In the present embodiment, the sheet feeding unit 100 is not limited to the above-described configuration and may be any other configuration capable of sending the sheet P to the image forming unit 200.

Image forming unit The image forming unit 200 includes, for example, a receiving cylinder 201 to receive the fed sheet P, a sheet bearing drum 210 to bear and convey the sheet P conveyed by the receiving cylinder 201 on an outer circumferential surface of the sheet bearing drum 210, an ink discharge unit 220 to discharge ink toward the sheet P borne on the sheet bearing drum 210, and a transfer cylinder 202 to transfer the sheet P conveyed by the sheet bearing drum 210 to the drying unit 300.

The leading end of the sheet P conveyed from the sheet feeding unit 100 to the image forming unit 200 is gripped by a sheet gripper disposed on the surface of the receiving cylinder 201 and conveyed with the movement of the surface of the receiving cylinder 201. The sheet conveyed by the receiving cylinder 201 is delivered to the sheet bearing drum 210 at a position facing the sheet bearing drum 210.

The sheet gripper is also disposed on the surface of the sheet bearing drum 210, and the leading end of the sheet is gripped by the sheet gripper. A plurality of suction holes are dispersedly formed on the surface of the sheet bearing drum 210, and a sucked air flow directed toward the inside of the sheet bearing drum 210 is generated in each suction hole by a suction device 211. The leading end of the sheet P delivered from the receiving cylinder 201 to the sheet bearing drum 210 is gripped by the sheet gripper, and the sheet is attracted to the surface of the sheet bearing drum 210 by the suction air flow and is conveyed with the movement of the surface of the sheet bearing drum 210.

The ink discharge unit 220 according to the present embodiment discharges inks of four colors of C (cyan), M (magenta), Y (yellow), and K (black) to form an image, and includes individual liquid discharge heads 220C, 220M, 220Y and 220K for respective inks. The configurations of the liquid discharge heads 220C, 220M, 220Y, and 220K are not limited to the above-described configurations and may be any other suitable configurations. The ink discharge unit 220 may include, for example, a liquid discharge head to discharge special ink, such as white, gold, and silver, or a liquid discharge head to discharge a liquid that does not constitute an image, such as a surface coating liquid, as needed.

The discharge operation of the liquid discharge heads 220C, 220M, 220Y, and 220K of the ink discharge unit 220 is controlled by drive signals corresponding to image information. When the sheet P borne on the sheet bearing drum 210 passes through a region opposed to the ink discharge unit 220, ink of respective colors is discharged from the liquid discharge heads 220C, 220M, 220Y, and 220K to form an image in accordance with the image information. In the present embodiment, the configuration of the image forming unit 200 is not limited to the above-described configuration and may be any other configuration of forming an image by causing liquid to adhere onto the sheet P.

Drying unit The drying unit 300 includes, for example, a drying assembly 301 to dry the ink adhered onto the sheet P by the image forming unit 200, and a conveyance assembly 302 to convey the sheet P conveyed from the image forming unit 200. After the sheet P conveyed from the image forming unit 200 is received by the conveyance assembly 302, the sheet is conveyed to pass through the drying assembly 301 and delivered to the sheet ejection unit 400. When the sheet P passes the drying assembly 301, the ink on the sheet P is subjected to a drying process. Thus, the liquid content, such as moisture, in the ink evaporates, the ink is fixed on the sheet P, and the curl of the sheet P is reduced.

Sheet ejection unit The sheet ejection unit 400 includes, for example, a sheet ejection tray 410 on which a plurality of sheet P is stacked. The sheet P conveyed from the drying unit 300 is sequentially stacked and held on the sheet ejection tray 410. In the present embodiment, the configuration of the sheet ejection unit 400 is not limited to the above-described configuration and may be any other configuration capable of ejecting the sheet P.

Other functional units The inkjet recording apparatus 1 according to the present embodiment includes the sheet feeding unit 100, the image forming unit 200, the drying unit 300, and the sheet ejection unit 400. In addition, other functional units may be added as needed. For example, a pre-processing unit to perform pre-processing of image formation can be added between the sheet feeding unit 100 and the image forming unit 200, or a post-processing unit to perform post-processing of image formation can be added between the drying unit 300 and the sheet ejection unit 400.

As the pre-processing unit, for example, there is a unit to perform a treatment liquid application process of applying a treatment liquid for reacting with ink to reduce bleeding to the sheet P. However, the content of the pre-processing is not particularly limited to any specific content. In addition, as the post-processing unit, for example, there is a sheet reverse conveyance processing with the image formed by the image forming unit 200 and sending the sheet to the image forming unit 200 again to form images on both sides of the sheet, or a process for binding a plurality of sheets on which the image is formed, and the like. However, the content of the post-processing is also not particularly limited to any specific content.

In the present embodiment, the printing apparatus is described using an example of an inkjet recording apparatus. However, the "printing apparatus" is not limited to an apparatus that includes a liquid discharge head to discharge liquid toward a surface to be dried of the sheet material, and to make visible significant images, such as letters and graphics, with the discharged liquid. For example, the "printing apparatus" may also be an apparatus to form patterns and the like which have no meaning. The material of the sheet material is not limited, and any sheet material, such as paper, thread, fiber, cloth, leather, metal, plastic, glass, wood, and ceramics, to which liquid can temporarily adhere may be used. For example, sheet materials used for film products, cloth products, such as clothing products, building materials, such as a wall sheet or flooring materials, leather products, and the like may be used. The "printing apparatus" can also include units relating to feeding, conveying, and ejection of a sheet to which liquid can adhere, a pre-processing device, a post-processing device and the like. Further, the term "liquid" includes any liquid having a viscosity or a surface tension that can be discharged from the head. The "liquid" is not limited to a particular liquid and may be any liquid having a viscosity or a surface tension to be discharged from a head. However, preferably, the viscosity of the liquid is not greater than 30 mPa·s under ordinary temperature and ordinary pressure or by heating or cooling. More specifically, the "liquid" is, for example, solution, suspension, emulsion or the like that includes a solvent, such as water or an organic solvent, a colorant, such as a dye or a pigment, a functionalizing material, such as a polymerizable compound, a resin, or a surfactant, a biocompatible material, such as DNA, amino acid, protein, or calcium, edible materials, such as natural colorants, and the like. Such liquids can be used, for example, for inkjet inks, surface treatment liquids and the like. Although there is an apparatus in which the liquid discharge head and the sheet material relatively move as the "printing apparatus", embodiments of the present disclosure are not limited to such an apparatus. The "printing apparatus" may be, for example, a serial-type apparatus to move a liquid discharge head relative to a sheet material or a line-type apparatus that does not move a liquid discharge head relative to a sheet material.

Further, the term "liquid discharge head" represents a functional component to discharge and jet liquid from discharge orifices (nozzles). As an energy generating source to discharge liquid, a discharge energy generator, for example, a piezoelectric actuator (lamination-type piezoelectric element and thin-film piezoelectric element), a thermal actuator using an electrothermal transducer element, such as a heating resistor (element), or an electrostatic actuator including a diaphragm plate and opposed electrodes can be used. However, the energy generating source is not limited to any specific type and may be any other suitable discharge energy generator.

Figure 2:
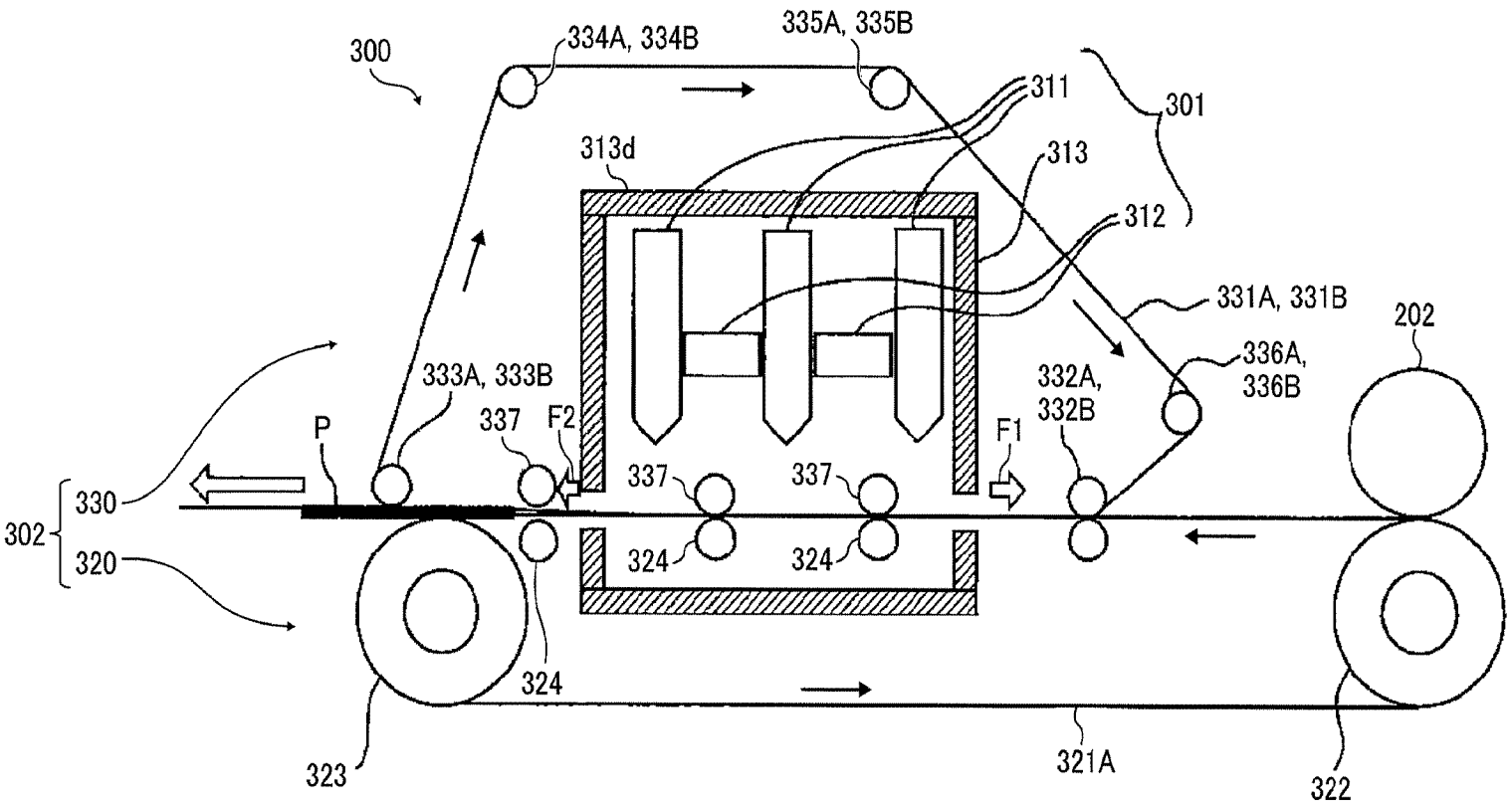
FIG. 2 is a front view of a drying unit of the inkjet recording apparatus of FIG. 1.
Figure 3:
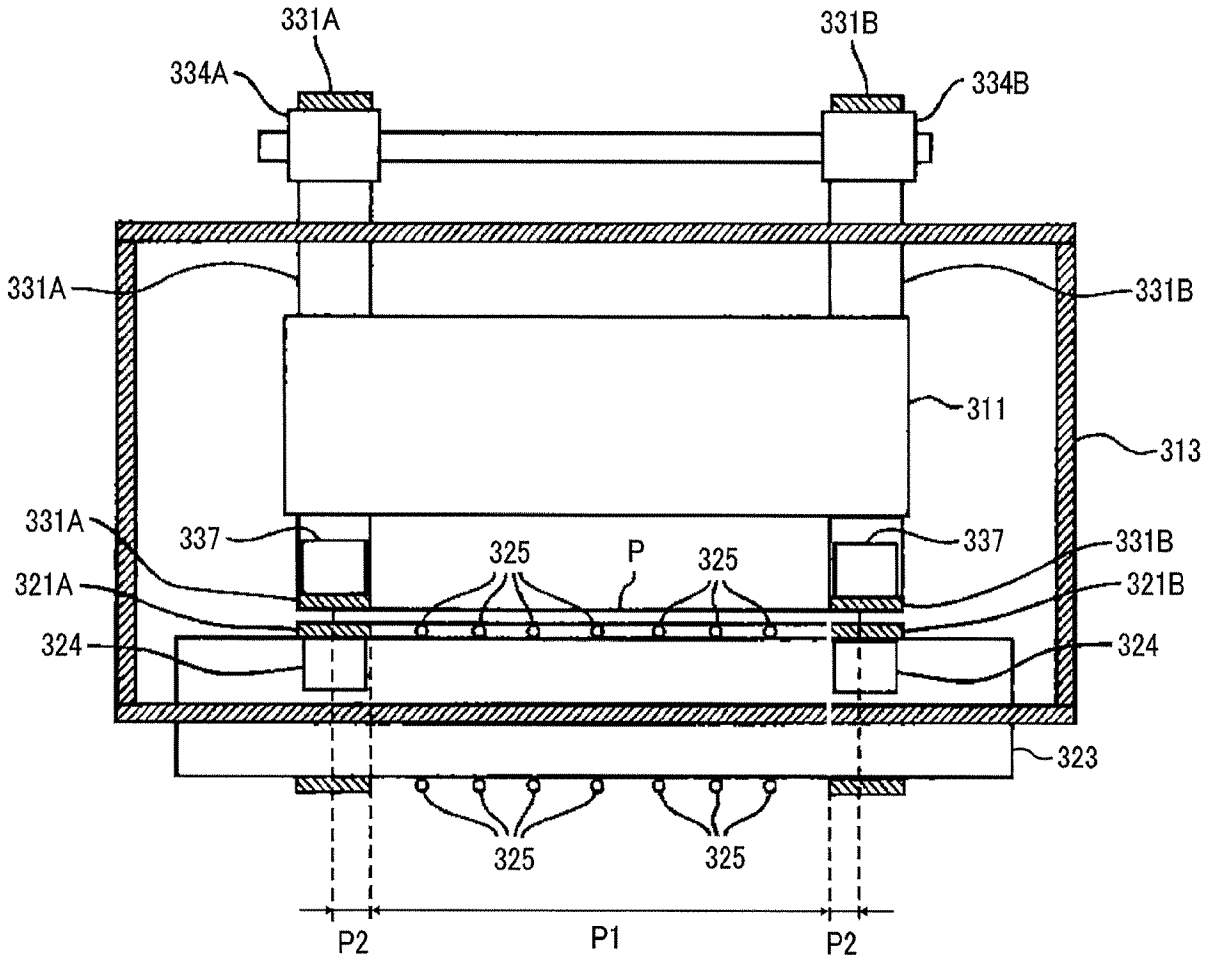
FIG. 3 is a cross-sectional view of the drying unit cut along a plane perpendicular to a sheet conveyance direction.

Details of drying unit Next, the drying unit 300 in the present embodiment is further described below. FIG. 2 is a front view of the drying unit 300 in the present embodiment. FIG. 3 is a cross-sectional view of the drying unit 300 in the present embodiment, cut along a plane perpendicular to a sheet conveyance direction (indicated by arrow D in FIG. 5) in which a sheet P is conveyed by the conveyance assembly 302.

The drying assembly 301 in the drying unit 300 in the present embodiment includes, for example, a blowing fan 311 to blow air toward the sheet P conveyed by the conveyance assembly 302, a radiation heater 312, and a drying chamber 313 formed by surrounding the periphery of the blowing region blown by the blowing fan 311 with a wall member 313*d*. At least a part of the wall member 313*d* of the drying chamber 313 is formed of a heat insulating material so that the internal temperature of the drying chamber 313 is not easily lowered. In the drying assembly 301, ink on an image surface (a surface on which liquid, such as ink, is applied) of the sheet P is dried by the radiant heat of the radiation heater 312 and the air blown by the blowing fan 311 with respect to the image surface of the sheet P conveyed to the internal space of the drying chamber 313.

In the drying assembly 301 of the present embodiment, a plurality of (three in the present embodiment) blowing fans 311 is disposed side by side in the sheet conveyance direction D. However, the number and arrangement of the blowing fans 311 are not limited to any particular number and arrangement and may be any other suitable number and arrangement. In the drying assembly 301 of the present embodiment, a plurality (two in the embodiment) of the radiation heaters 312 is disposed side by side in the sheet conveyance direction D. However, the number and arrangement of the radiation heaters 312 are also not limited to any particular number and arrangement and may be any other suitable number and arrangement.

Figure 4:
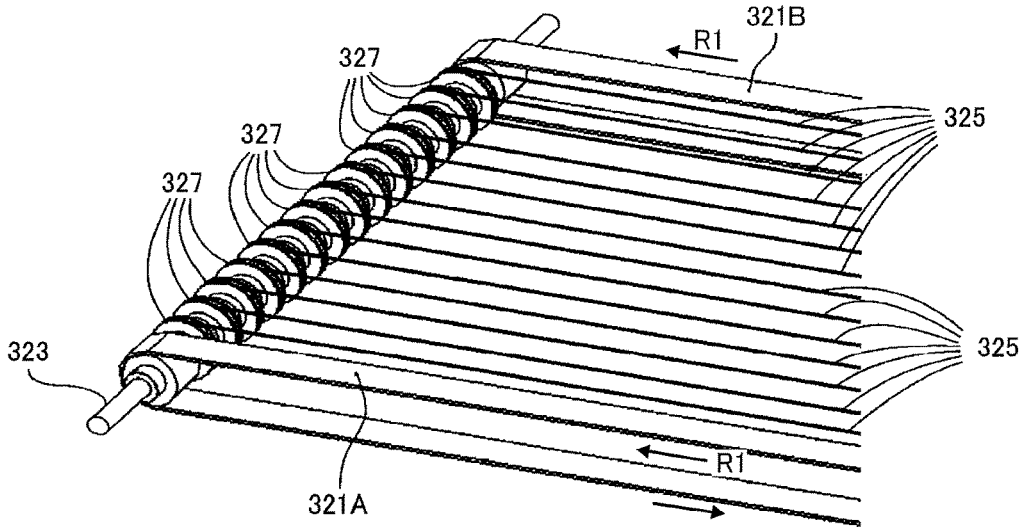
FIG. 4 is a perspective view of a portion of a belt conveyor of a conveyance assembly in the drying unit.

FIG. 4 is a perspective view of a portion of a belt conveyor 320 of the conveyance assembly 302 in the present embodiment. The conveyance assembly 302 in the present embodiment includes, for example, the belt conveyor 320 and a sheet presser 330. The belt conveyor 320 bears both end regions P2 in the width direction of the sheet P on the surfaces of the endless conveyance belts 321A and 321B stretched over the two support rollers 322 and 323, and conveys the sheet P in accordance with the movement of the surfaces of the conveyance belts 321A and 321B. Note that the width direction of the sheet P used herein represents a direction perpendicular to the sheet conveyance direction D in which the sheet P is conveyed with the conveyance belts 321A and 321B. The sheet presser 330 presses the sheet P borne on the surfaces of the conveyance belts 321A and 321B toward the surfaces of the conveyance belts 321A and 321B, and mainly functions to enhance the sheet conveyance performance of the belt conveyor 320.

By drying mainly at least one of the two support rollers 322 and 323, the conveyance belts 321A and 321B are traveled in a direction of arrow R1 in the FIG. 4 to move the surfaces. The conveyance belts 321A and 321B may be made of, for example, metal or rubber. However, the material of the conveyance belts 321A and 321B is not limited to any particular material. However, in the present embodiment, it may be preferable to use a heat-resistant material (heat-resistant rubber, metal, or the like) in consideration of being exposed to a high temperature when passing through the inside of the drying chamber 313.

An upstream portion of each of the conveyance belts 321A and 321B in the sheet conveyance direction D (a belt portion wound around the first support roller 322) is disposed to face the transfer cylinder 202 of the image forming unit 200. The sheet P conveyed by the transfer cylinder 202 is delivered to the conveyance belts 321A and 321B in such a manner that the end regions P2 in the width direction on a back side of the image surface of the sheet P face the surfaces of the conveyance belts 321A and 321B, and the sheet P is borne on the surfaces of the conveyance belts 321A and 321B. The sheet P borne on the surfaces of the conveyance belts 321A and 321B is conveyed to the side of the second support roller 323 with the movement of the surfaces of the conveyance belts 321A and 321B.

The sheet P is held on the surfaces of the conveyance belts 321A and 321B mainly by the action of electrostatic force or frictional force, and the conveyance belts 321A and 321B in the present embodiment do not have a mechanism, such as a sheet gripper. However, in some embodiments, the sheet P may be held on the surfaces of the conveyance belts 321A and 321B by a sheet gripper or the like.

A belt portion (a belt portion that moves from the first support roller 322 to the second support roller 323) that bears the sheet on each of the conveyance belts 321A and 321B is disposed to pass through the inside of the drying chamber 313 of the drying assembly 301. Accordingly, the sheet P borne on the surfaces of the conveyance belts 321A and 321B passes through the inside of the drying chamber 313 of the drying assembly 301 with the movement of the surfaces of the conveyance belts 321A and 321B. Then, the sheet P is separated from the surfaces of the conveyance belts 321A and 321B and is delivered to the sheet ejection unit 400 via a guide plate, a conveyance roller, or the like.

The sheet presser 330 according to the present embodiment includes two end pressing belts 331A and 331B to support the portions of the sheet P (i.e., both end regions P2 in the width direction of the sheet P) borne on the surfaces of the conveyance belts 321A and 321B. One end pressing belt 331A is an endless belt stretched over the five support rollers 332A, 333A, 334A, 335A and 336A, and abuts against one end region of the sheet P in the width direction of the sheet P to press the sheet toward the surface of the conveyance belt 321A. Thus, the one end region of the sheet P in the width direction is sandwiched with the conveyance belt 321A and the end pressing belt 331A. Similarly, the other end pressing belt 331B is also an endless belt stretched over five support rollers 332B, 333B, 334B, 335B and 336B and abuts against the other end region of the sheet P in the width direction of the sheet P to press the sheet toward the surface of the conveyance belt 321B. Thus, the other end region of the sheet P in the width direction is sandwiched with the conveyance belt 321B and the end pressing belt 331B. Each of the support rollers supporting the two end pressing belts 331A and 331B is disposed on a common rotation axis between the two end pressing belts 331A and 331B.

As the material of the two end pressing belts 331A and 331B, metal, rubber or the like can be used, and the material is not limited to any particular material. However, it may be preferable to use a heat-resistant material (heat resistant rubber, metal, or the like) in consideration of being exposed to a high temperature when passing through the inside of the drying chamber 313.

The two end pressing belts 331A and 331B are belt portions that move from the first support rollers 332A and 332B toward the second support rollers 333A and 333B. The two end pressing belts 331A and 331B press the end regions P2 of the sheet P in the width direction toward the surfaces of the conveyance belts 321 A and 321B, respectively. In the present embodiment, three pressing rollers 337 are disposed on the inner circumferential face side of the belt portion of each of the two end pressing belts 331A and 331B. Back-up rollers 324 are disposed on the inner circumferential face side of each of the conveyance belts 321A and 321B of the belt conveyor 320 at positions facing the pressing rollers 337 and each of the first support rollers 332A and 332B. As a result, both end regions P2 in the width direction of the sheet P borne on the surfaces of the conveyance belts 321A and 321B are continuously pressed by the two end pressing belts 331A and 331B at a sufficient pressure, at least in a section from the first support rollers 332A and 332B to the pressing rollers 337 located on the most downstream side in the sheet conveyance direction D. Thus, the state of being sandwiched between the two end pressing belts 331A and 331B and the surfaces of the conveyance belts 321A and 321B is maintained.

The conveyance belts 321A and 321B in the present embodiment are configured to be movable in the width direction of the sheet P. The two end pressing belts 331A and 331B in the present embodiment are configured to be movable in the width direction of the sheet P, together with the five support rollers, the pressing rollers 337 and the back-up rollers 324 stretching and supporting the two end pressing belts 331A and 331B. Such a configuration allows both end regions P2 of the sheet in the width direction to be sandwiched between the conveyance belts 321A and 321B and the two end pressing belts 331A and 331B, even in the sheets of different sizes in the width direction. The length in the width direction of each end region P2 in the width direction of the sheet sandwiched between the conveyance belts 321A and 321B and the two end pressing belts 331A and 331B is set to about several mm (for example, 5 mm or more and 10 mm or less), and only a margin portion (non-image forming region) may be preferably pressed by the two end pressing belts 331A and 331B.

Figure 5:
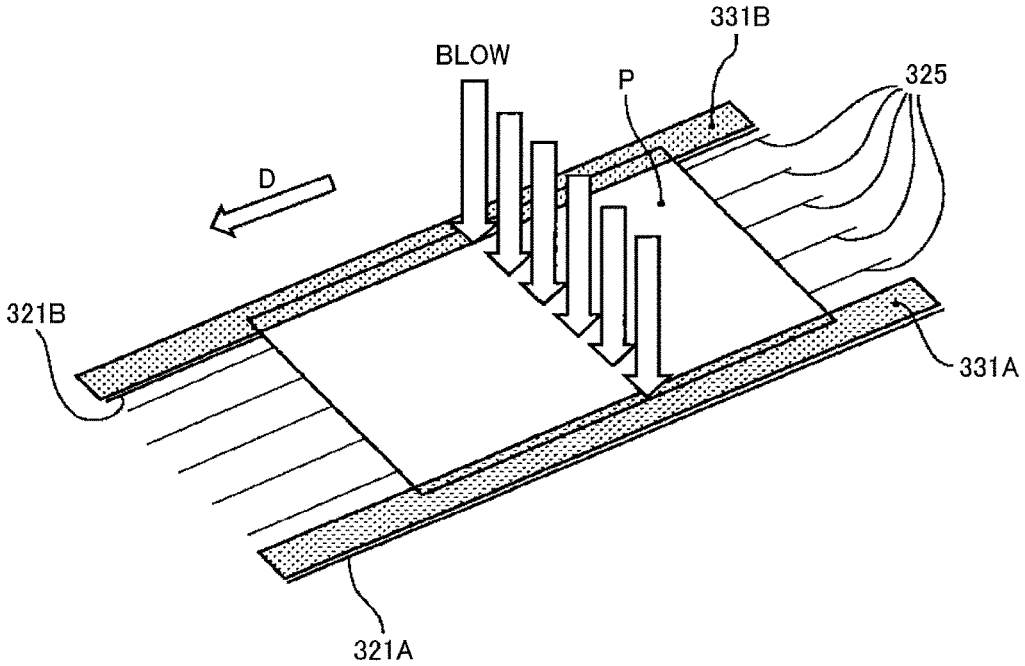
FIG. 5 is an illustration of a state in which air from a blowing fan hits on a sheet passing a blowing region of the drying unit.

Reduction of flutter of leading end of sheet FIG. 5 is an illustration of a state in which air from the blowing fan 311 hits on the sheet P passing a blowing region. According to the present embodiment, the sheet P borne on the surfaces of the conveyance belts 321A and 321B receives an air blow (of, e.g., approximately 20 m/s) from the blowing fan 311 in a direction substantially normal to the image surface (blowing target surface) of the sheet P when the sheet P passes through the inside of the drying chamber 313 of the drying assembly 301. At this time, the conveyance belts 321A and 321B of the present embodiment do not bear a sheet portion located within the blowing region blown by the blowing fan 311, specifically, an inner region (hereinafter, center region) P1 of the sheet P in the width direction of the sheet P excluding both end regions P2 in the width direction sandwiched between the conveyance belts 321A and 321B and the two end pressing belts 331A and 331B, from the back side of the image surface (blown surface) of the sheet P. Accordingly, when the air from the blowing fan 311 hits the image surface (blown surface) of the sheet P, the sheet P may be pushed and bent by the air and the end regions P2 in the width direction might be deviated, thus causing a conveyance failure.

Hence, in the present embodiment, support wires 325 are disposed as sheet material supporters to support the center region P1 in the width direction of the sheet P located within the blowing region, from the back side of the image surface (blown surface) of the sheet P. Even when the air from the blowing fan 311 hits the image surface (blown surface) of the sheet P, such a configuration can reduce a situation in which the sheet P is pushed and bent by the air. Therefore, a conveyance failure (a conveyance failure occurring when the center region P1 of the sheet P in the width direction of the sheet P is pushed by the blown air, the sheet bends, and the deviation of the sheet occurs at a sandwiching position of the sheet) is reduced which may occur in a configuration in which the sheet is conveyed while sandwiching only both end regions P2 of the sheet P in the width direction.

Figure 6:
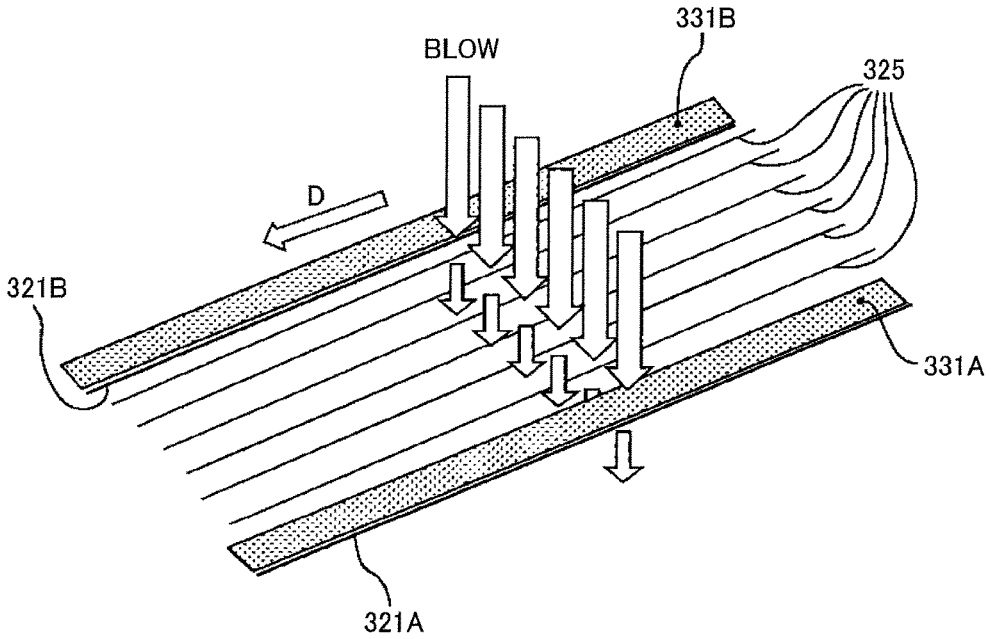
FIG. 6 is an illustration of a state in which a wind from the blowing fan passes through gaps between support wires in the drying unit.

FIG. 6 is an illustration of a state in which air blown from the blowing fan 311 passes through gaps between the support wires 325. In a configuration in which the center region P1 in the width direction of the sheet P located within the blowing region is supported by a windproof supporting member (through which a wind cannot pass), for example, a windproof conveyance belt to entirely bear a back side of the sheet P on the belt surface is used instead of the above-described the conveyance belts 321A and 321B, a wind blown from the blowing fan 311 hits on the surface of the windproof supporting member before the entry of the sheet P into the blowing region. As a result, an air flow occurs that flows along the surface of the windproof supporting member. Such an air flow may move toward the leading end of the sheet P conveyed from the upstream side in the sheet conveyance direction D and flutter the center region P1 in the width direction of the sheet P, which is not sandwiched between the windproof supporting member and each of the end pressing belts 331A and 331B. Accordingly, a conveyance failure might occur.

Hence, in the present embodiment, the wind-permeable sheet material supporters, through which a wind passes, are disposed as support members to support the center region P1 in the width direction of the sheet P located within the blowing region, from the back side of the image surface (blown surface) of the sheet P. As the wind-permeable sheet material supporters, a structure is employed in which the plurality of support wires 325 are spaced away from each other to support a sheet material. Such a configuration allows at least a portion of the wind from the blowing fan 311 to pass the gaps between the support wires 325. Even if the wind from the blowing fan 311 hits on the support wires 325 before the entry of the sheet P into the blowing region, such a configuration weakens the strength of an air flow moving toward the leading end of the sheet P along the support wires 325. Accordingly, the fluttering of the center region P1 in the width direction of the leading end of the sheet P can be reduced and a conveyance failure can be reduced, thus allowing stable sheet conveyance.

The support wires 325 in the present embodiment have a configuration in which a plurality of endless wires, which are linear members long along the sheet conveyance direction D, are stretched taut by a plurality of support pulleys and arranged side by side in the width direction of the sheet P. The support wires 325 may be made of, for example, metal or rubber. However, the material of the support wires 325 is not limited to any particular material. However, it may be preferable to use a heat-resistant material (heat resistant rubber, metal, or the like) in consideration of being exposed to a high temperature when passing through the inside of the drying chamber 313. In addition, the support wires 325 according to the present embodiment are metal wires having a diameter of approximately 1 mm. However, embodiments of the present disclosure are not limited to such metal wires.

Furthermore, according to the present embodiment, sheet opposing portions of the support wires 325, which oppose the sheet P, move to the downstream side in the sheet conveyance direction D. As a driver of the support wires 325, for example, a dedicated drive motor for driving the support wires 325 may be employed to rotatably drive support pulleys. However, in the present embodiment, other type of driver is used. That is, support pulleys 326 and 327, over which the support wires 325 are stretched, are coaxially disposed with the support rollers 322 and 323, over which the conveyance belts 321A and 321B are stretched. Accordingly, by driving the conveyance belts 321A and 321B, the support rollers 322 and 323 are rotated and the support pulleys 326 and 327 are also rotated, thus allowing movement of the support wires 325.

As described above, for the configuration in which the sheet opposing portions of the support wires 325 moves downstream in the sheet conveyance direction D, the difference in speed between the surface movement speed of the back side of the sheet P contacting the support wires 325 and the movement speed of the support wires 325 can be smaller than the difference in speed in a fixed configuration in which the support wires 325 are immovable or can be zero. Such a configuration can reduce the conveyance resistance due to the contact of the support wires 325 with the back side of the sheet P, thus allowing more stable conveyance performance.

Figure 7:
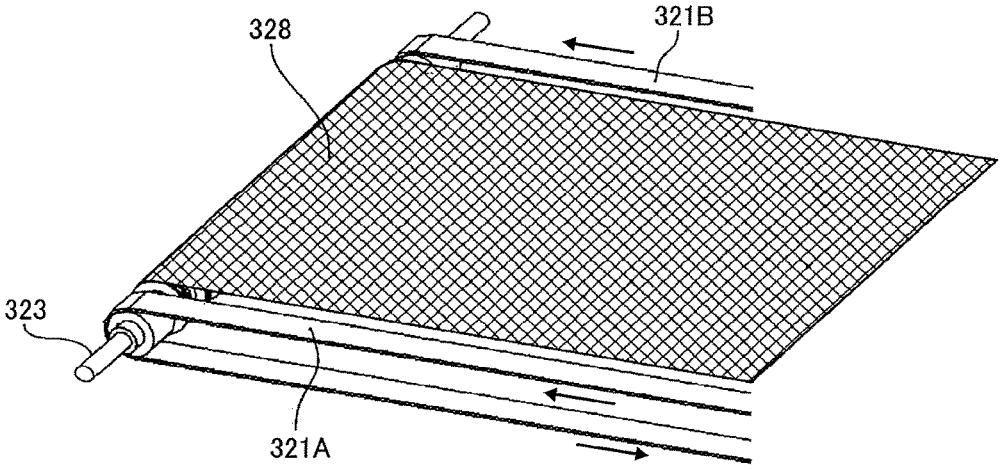
FIG. 7 is a perspective view of another example of the belt conveyor of the drying unit.
Figure 8:
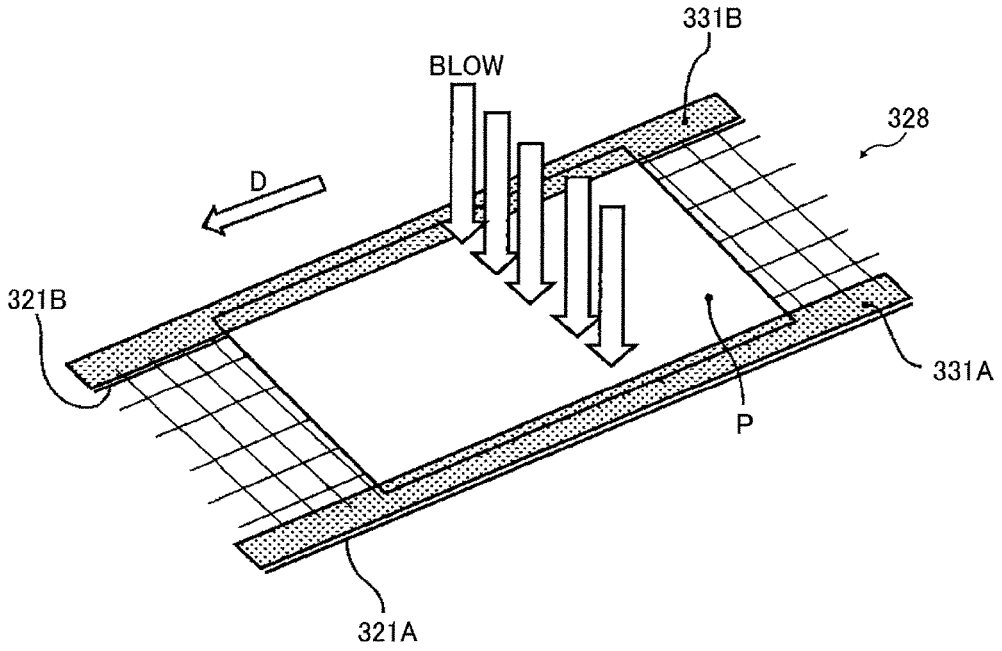
FIG. 8 is an illustration of a state in which air from a blowing fan hits on a sheet passing a blowing region of the drying unit of FIG. 7.
Figure 9:
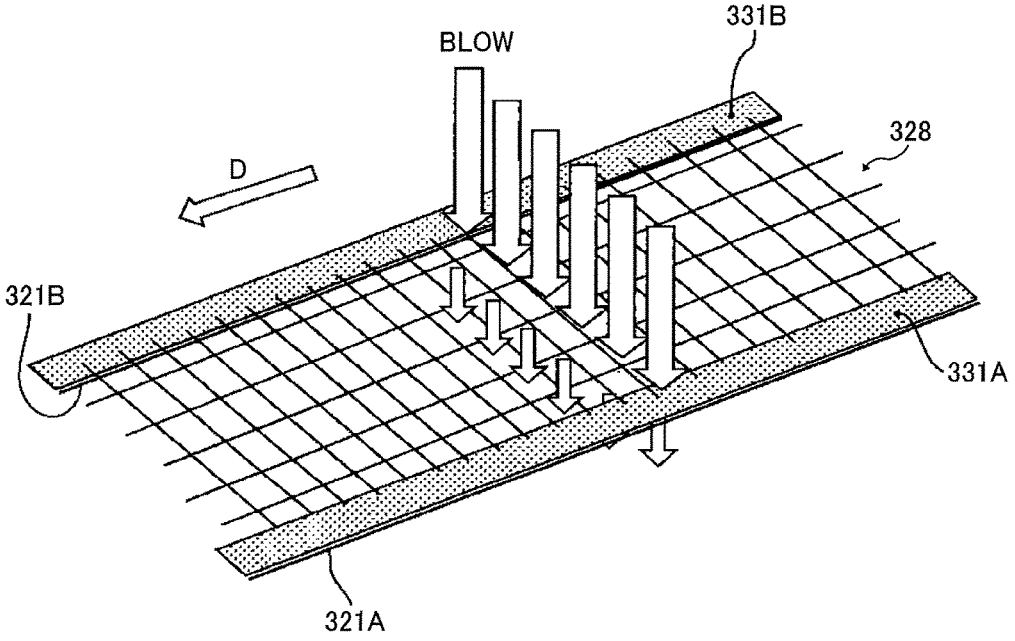
FIG. 9 is an illustration of a state in which a wind from the blowing fan passes through gaps of a meshed belt in the drying unit.

Note that, for the sheet material supporter to support the back side of the image surface (blown surface) of the center region P1 in the width direction of the sheet P located within the blowing region, the configuration is not limited to the above-described configuration in which the plurality of support wires 325 are spaced away from each other and may be any other wind-permeable configuration. Accordingly, for example, as illustrated in FIG. 7, a meshed belt 328, in which linear members are arranged in mesh state, may be employed. As illustrated in FIG. 8, such a meshed belt 328 can reduce a state in which, when a wind from the blowing fan 311 hits on the image surface (blown surface) of the sheet P, the sheet P is pushed and bent, thus reducing a conveyance failure. Further, as illustrated in FIG. 9, since at least a portion of the wind from the blowing fan 311 can pass through gaps of the meshed belt 328, the strength of an air flow toward the leading end of the sheet P along the meshed belt 328 can be weaken and the fluttering of the center region P1 in the width direction of the leading end of the sheet P can be reduced, thus allowing stable sheet conveyance.

As the occupancy area of the support wires 325 or the meshed belt 328 is smaller, that is, the gaps, through which wind from the blowing fan 311 passes, are larger, the strength of the air flow toward the leading end of the sheet P decreases, thus highly effectively reducing the fluttering of the center region P1 in the width direction of the leading end of the sheet P. In such a case, the contact area in which the support wires 325 or the meshed belt 328 contacts the back side of the sheet P also decreases, thus highly effectively reducing uneven drying of the sheet P.

Figure 10:
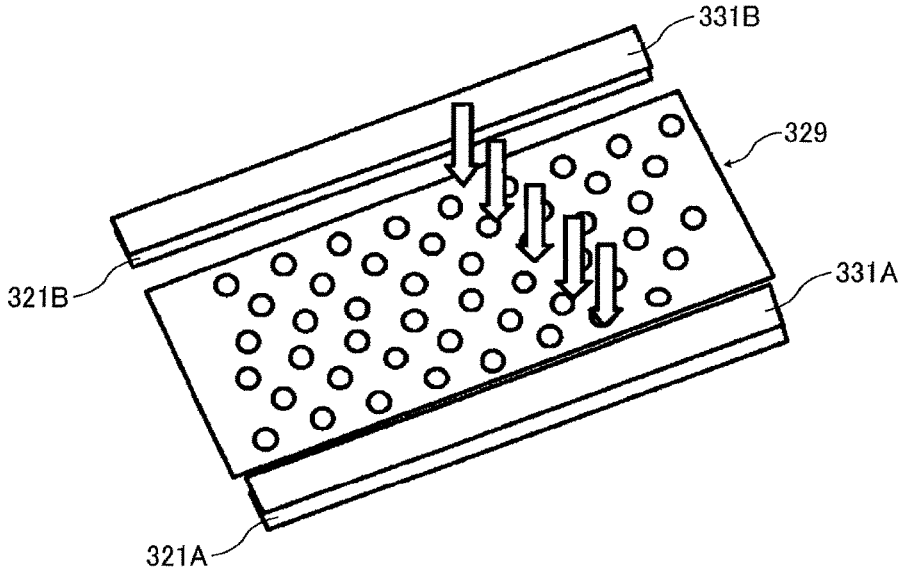
FIG. 10 is a perspective view of still another example of the belt conveyor of the drying unit.

As the wind-permeable sheet material supporter, for example, as illustrated in FIG. 10, a plane porous belt 329 being a planar belt including multiple through-holes may be employed. Such a porous belt 329 is less permeable with respect to the wind from the blowing fan than the sheet material supporter, in which the above-described plurality of support wires 325 are spaced away from each other, or the meshed belt 328. However, the porous belt 329 can achieve a sufficient wind-permeation performance depending on the amount of wind from the blowing fan.

Figure 11:
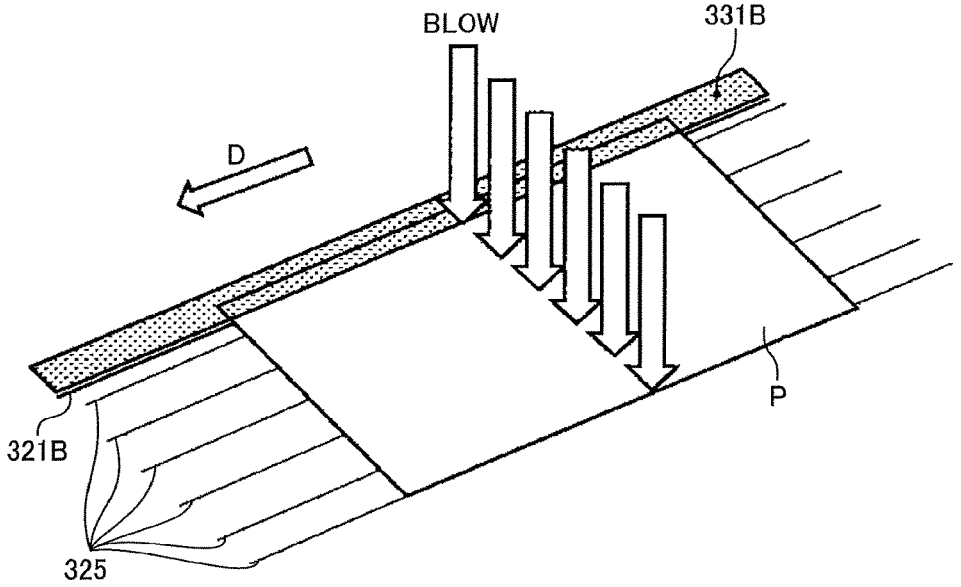
FIG. 11 is a perspective view of still yet another example of the belt conveyor of the drying unit.
Figure 12:
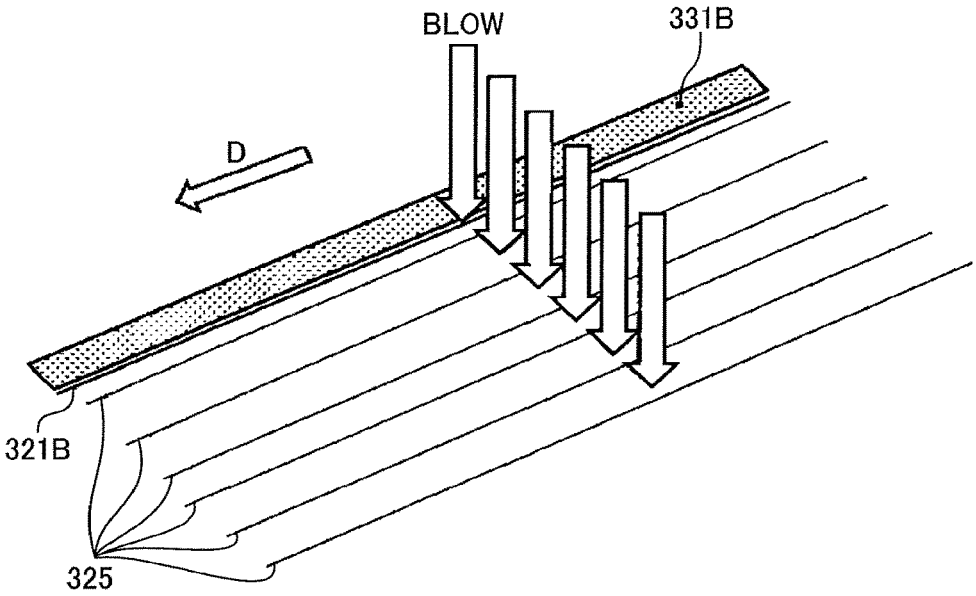
FIG. 12 is an illustration of a state in which a wind from the blowing fan passes through gaps between support wires in the drying unit.

In the present embodiment, the sheet P is conveyed with the end regions P2 in the width direction of the sheet P sandwiched between the conveyance belts 321A and 321B and the end pressing belts 331A and 331B, respectively. However, the configuration is not limited to such a configuration. For example, for a configuration, such as the present embodiment, in which the center region P1 in the width direction is supported with the sheet material supporter, such as the support wires 325, as illustrated in FIG. 11, the sheet P may be conveyed with only one end region in the width direction of the sheet P sandwiched between the conveyance belt 321B and the end pressing belt 331B. Such a configuration can apply a conveyance force to the sheet P to convey the sheet P and reduce the cost by simplification of the configuration. Further, such a configuration can reduce a state in which the sheet P is pushed and bent when a wind from the blowing fan 311 hits on the image surface (blown surface) of the sheet P, thus reducing a conveyance failure. As illustrated in FIG. 12, since at least a portion of the wind from the blowing fan 311 passes through gaps between the support wires 325, the fluttering of the center region P1 in the width direction of the leading end of the sheet P can be reduced, thus allowing stable sheet conveyance.

Figure 13:
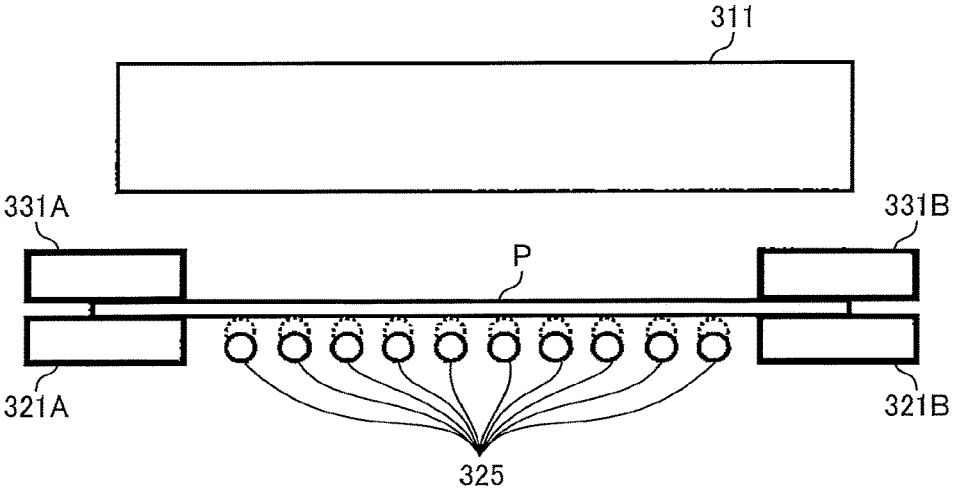
FIG. 13 is a perspective view of still yet another example of the belt conveyor of the drying unit.

In the present embodiment, as indicated by broken lines in FIG. 13, the positions of the support wires 325 in the normal direction of the image surface (blown surface) of the sheet P are disposed at substantially the same positions as the sandwiching positions of the conveyance belts 321A and 321B and the end pressing belts 331A and 331B at which the sheet P is sandwiched with the conveyance belts 321A and 321B and the end pressing belts 331A and 331B, respectively. However, in some embodiments, as indicated by solid lines in FIG. 13, the positions of the support wires 325 in the normal direction of the image surface (blown surface) of the sheet P may be disposed further away from the blowing fan 311 than the sandwiching positions of the conveyance belts 321A and 321B and the end pressing belts 331A and 331B. In such a case, in a situation in which the sheet P is not deviated at the sandwiching positions by the wind from the blowing fan 311, the support wires 325 do not contact the back side of the sheet P, thus allowing a reduction in conveyance resistance and more stable conveyance performance. Further, in such a case, even when the sheet P is deviated at the sandwiching positions by wind from the blowing fan 311, the support wires 325 support the back side of the sheet P, thus reducing conveyance failure.

In the present embodiment, the end regions of the sheet P are sandwiched between the conveyance belts 321A and 321B and the end pressing belts 331A and 331B. In some embodiments, instead of the conveyance belts 321A and 321B, end regions of a wind-permeable sheet material supporter may be used so that end portions of the sheet P are sandwiched between the end regions of the sheet material supporter and the end pressing belts 331A and 331B.

Figure 14:
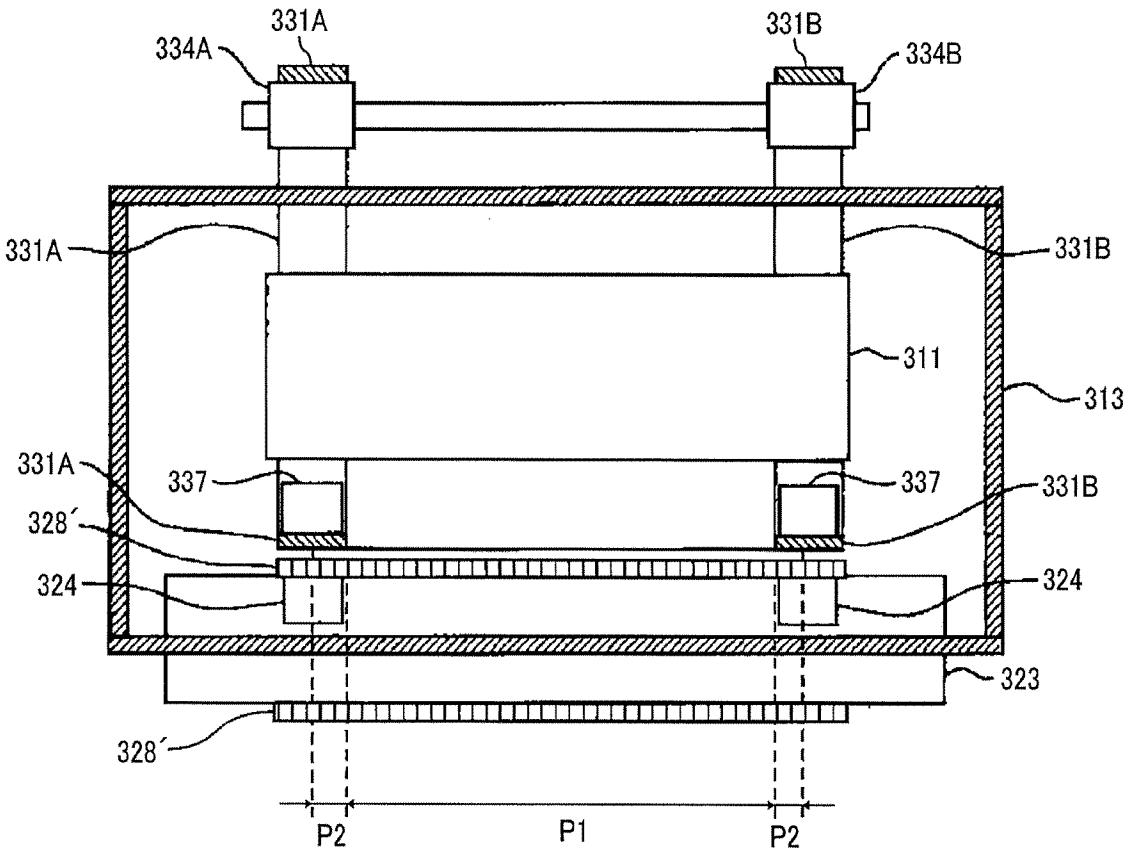
FIG. 14 is a cross-sectional view of the drying unit cut along a plane perpendicular to the sheet conveyance direction in an example in which a meshed belt is used as a wind-permeable sheet material supporter.

For example, as illustrated in FIG. 14, a meshed belt 328', in which linear members are arranged in mesh state, may be employed as the wind-permeable sheet material supporter. In such a case, end portions of the sheet P may be sandwiched between end regions of the meshed belt 328' and the end pressing belts 331A and 331B.

The drying unit 300 of the present embodiment does not necessarily need to include a heat generator, such as the radiation heater 312, since the drying unit 300 includes the blower, such as the blowing fan 311, blows air toward the sheet P. However, the drying unit 300 preferably includes the heat generator to dry ink in a shorter time. The heat generator is not limited to a unit that generates radiant heat like the radiation heater 312. A unit that generates heat transmitted from the member to contact the sheet P, such as the conveyance belts 321A and 321B or the end pressing belts 331A and 331B, to the sheet P may be used. In addition, a heat generator to raise the temperature inside the drying chamber 313 may also be employed. In such a case, the blowing fan 311 may be used to blow warm air to the sheet P.

The blowing fan 311 of the present embodiment includes a built-in heater. Settings of various parameters, such as the temperature of the heater, the air speed and air volume of the blowing fan 311, and the distance between the blowing fan 311 and the surface of each of the conveyance belts 321A and 321B, can be changed by a controller. The setting values of various parameters are changed in accordance with, for example, the type of the sheet P, the ink adhesion amount to the sheet P, the sheet conveyance speeds of the conveyance belts 321A and 321B, and the like. For example, the controller may change setting values of various parameters on the basis of input information that is input by an operator through a control panel provided in the inkjet recording apparatus 1, or may change the setting values of various parameters, using data or program stored in advance in the storage device. The various parameters can be manually adjusted by an operator.

Setting of parameters, such as the output wavelength of the radiation heater 312, are also changeable in accordance with, for example, the type of the sheet P, the ink adhesion amount to the sheet P, or the sheet conveyance speeds of the conveyance belts 321A and 321B. For changing the setting of parameters, as in the case of the blowing fan 311, for example, setting values of various parameters may be changed based on input information that is input by an operator through a control panel provided in the inkjet recording apparatus, or the setting values of various parameters may be changed, using data or programs stored in the storage device. Manual adjustment can also be performed by the operator.

The two end pressing belts 331A and 331B in the present embodiment rotate with the movement of the surfaces of the conveyance belts 321A and 321B. In some embodiments, for example, the two end pressing belts 331A and 331B may be driven by the driving force of one of the support rollers. Even in such a case, it is preferable to drive the two end pressing belts 331A and 331B so that the surfaces of the two end pressing belts 331A and 331B move at the same speed as the speed of movement of the surfaces of the conveyance belts 321A and 321B. If there is a speed difference between the surfaces of the two end pressing belts 331A and 331B and the surfaces of the conveyance belts 321A and 321B, the sheet P sandwiched between the end pressing belts 331A and 331B and the conveyance belts 321A and 321B might slip, thus causing the meandering or scratches of the sheet P.

The two end pressing belts 331A and 331B in the present embodiment are not entirely disposed in the drying chamber 313. As illustrated in FIGS. 2 and 3, a part of the two end pressing belts 331A and 331B is disposed to pass the outside of the drying chamber 313. In the present embodiment, the interior of the drying chamber 313 is heated to high temperatures. Accordingly, if the entire end pressing belts 331A and 331B are disposed in the drying chamber 313, the end pressing belts 331A and 331B would be exposed to high temperatures for a long period of time. As a result, the highest heated temperature of the end pressing belts 331A and 331B would increase, thus reducing the service life. According to the present embodiment, the end pressing belts 331A and 331B can be cooled down when passing the outside the drying chamber 313 and the highest heated temperature of the end pressing belts 331A and 331B can be lowered to lengthen the service life. In such a case, a cooler for cooling the end pressing belts 331A and 331B passing the outside of the drying chamber 313 may be provided. The cooler is not limited to any particular type of cooler. For example, an air-cooled cooling fan may be preferably employed.

Further, in the present embodiment, each of the contact portions in which the two end pressing belts 331A and 331B contact the conveyance belts 321A and 321B are sandwiched between the pressing roller 337 and the back-up roller 324. However, the setting of the sandwiching force can be changed according to, for example, the type or thickness of the sheet P. The setting change of the sandwiching force, for example, can be achieved by a configuration that changes the biasing force of the pressing roller 337 to change the sandwiching force, by changing the length of a biasing spring urging the pressing roller 337 toward the back-up roller 324.

In the present embodiment, three pressing rollers 337 are disposed side by side in the sheet conveyance direction D. The number and arrangement interval of the pressing rollers 337 can be set to any suitable number and arrangement interval as needed. For example, it is preferable to set the number and arrangement interval such that the sheet is always pressed by one or more pressing rollers 337 even when a minimum-size sheet (a sheet of the shortest length in the conveyance direction) is conveyed. In the present embodiment, the two end pressing belts 331A and 331B are configured to follow the conveyance belts 321A and 321B. For such a configuration, since the frictional force between the two end pressing belts 331A and 331B and the conveyance belts 321A and 321B, respectively, is increased by pressing of the pressing rollers 337, the pressing rollers 337 also contribute to stable follow-up of the end pressing belts 331A and 331B. The material of the pressing roller 337 is not particularly limited. However, considering that the pressing roller 337 is disposed inside the drying chamber 313 and is exposed to a high temperature for a long period of time, it may be preferable to use a heat-resistant material, particularly, a metal.

As illustrated in FIG. 7, a flat belt is adopted as each of the two end pressing belts 331A and 331B in the present embodiment. In some embodiments, other surface movable members, such as end pressing members made of a round belt or a metal wire having a circular cross-section may be used. Further, in the case of reducing the curling of the leading end and the trailing end of the sheet P, it may be sufficient to press the sheet P against the surfaces of the conveyance belts 321A and 321B. Hence, in some embodiments, a pressing member may be used to press the sheet P against the surfaces of the conveyance belts 321A and 321B by, for example, a flat spring rather than the surface movable member.

However, in the case of a flat belt as in the present embodiment, ends of the sheet P in the width direction can be fully covered, thus effectively preventing intrusion of air flows F1 and F2 from the ends of the sheet P in the width direction. Further, in the case of a flat belt as in the present embodiment, even in the positions at which the two end pressing belts 331A and 331B press the sheet P, outer portions of the end pressing belts 331A and 331B in the width direction can contact the surfaces of the conveyance belts 321A and 321B, respectively. In such as case, the contact areas between the two end pressing belts 331A and 331B and the conveyance belts 321A and 321B can be secured, which is advantageous for a case where the two end pressing belts 331A and 331B are rotated with movement of the surfaces of the conveyance belts 321A and 321B as in the present embodiment.

Meanwhile, in the case of the end pressing members made of round belts or metal wires, the contact area with the sheet P can be reduced and damage to the sheet P can be reduced. Moreover, it is easier to make the structure less expensive than in the case of a flat belt.

Variation Next, a description is given of a variation of the drying unit 300 in the present embodiment. In the above-described embodiment, an example of the drying unit 300 that dries a sheet after ink is discharged and an image is formed has been described. In the present variation, a treatment is performed in which a predetermined treatment liquid is imparted to the sheet P by, for example, application in the pre-processing unit. Before ink is discharged and an image is formed in the image forming unit 200, the sheet applied with the treatment liquid is dried in the drying unit.

Figure 15:
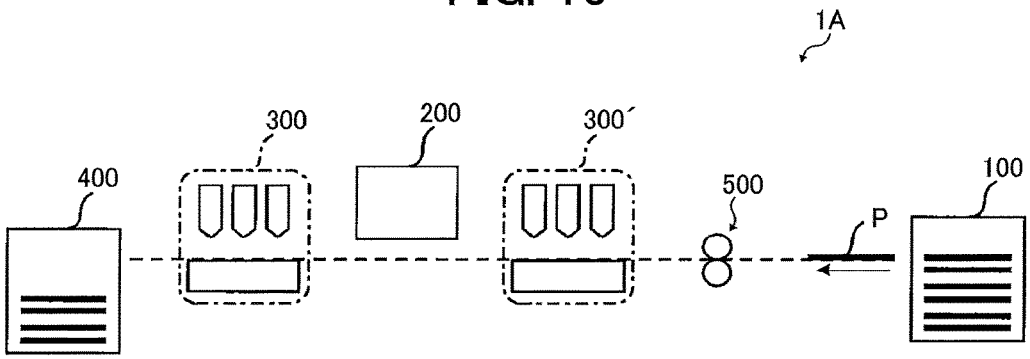
FIG. 15 is a schematic view of a configuration of an inkjet recording apparatus according to a variation of the present disclosure.

FIG. 15 is a schematic view of a configuration of an inkjet recording apparatus according to the present variation. An inkjet recording apparatus 1A according to the present variation has substantially the same basic configuration as the basic configuration of the inkjet recording apparatus 1 according to the above-described embodiment, except that a pre-processing unit 500 and a drying unit 300' are added between the sheet feeding unit 100 and the image forming unit 200. The basic configuration of the added drying unit 300' is also the same as in the above-described embodiment. Therefore, the differences from the above-described embodiment is mainly described below.

Figure 16:
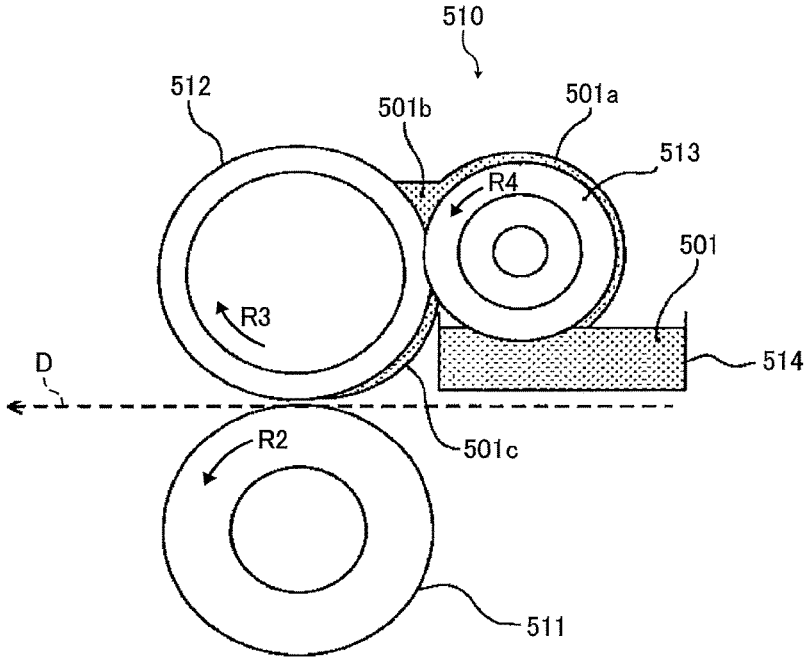
FIG. 16 is an illustration of a main part of an application device of the inkjet recording apparatus.

FIG. 16 is an illustration of a main part of an application device 510 as the pre-processing unit used in the present variation. The pre-processing unit 500 in the present variation includes the application device 510 to apply a treatment liquid to the sheet P fed from the sheet feeding unit 100. As the treatment liquid, for example, there is a modifying material to modify the surface of the sheet by being applied to the surface of the sheet. Specifically, there is a fixing agent (setting agent), in which, by preliminarily applying the ink to the sheet uniformly, the moisture of the ink is quickly permeated into the sheet, the color component is thickened, and the drying is accelerated to prevent bleeding (feathering, bleeding, or the like) or strike-through, and it is possible to enhance productivity (the number of images output per unit time).

Compositionally, as the treatment liquid, for example, a solution can be used in which cellulose (for example, hydroxypropyl cellulose) that promotes penetration of moisture and a base material, such as talc fine powder, are added to surfactant (for example, any one of anionic, cationic, and nonionic surfactants, or a mixture of two or more of the foregoing surfactants). The treatment liquid may also contain fine particles.

The application device 510 of the present variation includes a conveyance roller 511 to convey the sheet, an application roller 512 to apply a treatment liquid 501 to the sheet to face the conveyance roller 511, and a squeeze roller 513 to supply the treatment liquid 501 to the application roller 512 to thin the liquid film (the film of the treatment liquid 501). The directions of rotation of the conveyance roller 511, the application roller 512, and the squeeze roller are indicated by arrows R2, R3, and R4 in FIG. 16. In these rollers, the application roller 512 is disposed in contact with the conveyance roller 511, and the squeeze roller 513 is disposed in contact with the application roller 512.

In the present variation, when the treatment liquid 501 is applied to the sheet by the application device 510, by the rotation of the squeeze roller 513 in the direction indicated by arrow R4 in FIG. 16, the treatment liquid 501 in the liquid tray 514 is scooped up by the surface of the squeeze roller 513, is transferred in the state of the liquid film layer 501*a* by the rotation, and is accumulated on a valley portion (contact portion: nipping portion) between the squeeze roller 513 and the application roller 512 (treatment liquid 501*b*). Here, the squeeze roller 513 and the application roller 512 are in contact with each other at a constant pressing force. When the treatment liquid 501*b* stored in the valley portion passes between the squeeze roller 513 and the application roller 512, the treatment liquid 501*b* is squeezed by pressure. A liquid film layer 501*c* of the treatment liquid 501 is formed and is conveyed to the conveyance roller 511 side by the rotation of the application roller 512. The liquid film layer 501*c* transferred by the application roller 512 is applied to the sheet.

The sheet applied with the liquid film layer 501*c* of the treatment liquid 501 in such a manner is conveyed to the drying unit 300' having substantially the same configuration as the drying unit 300 of the above-described embodiment, and the drying process is performed. The sheet having been subjected to the drying process by the drying unit 300' is fed to the image forming unit 200, and an image is formed by discharging of ink in the image forming unit 200.

Figure 17:
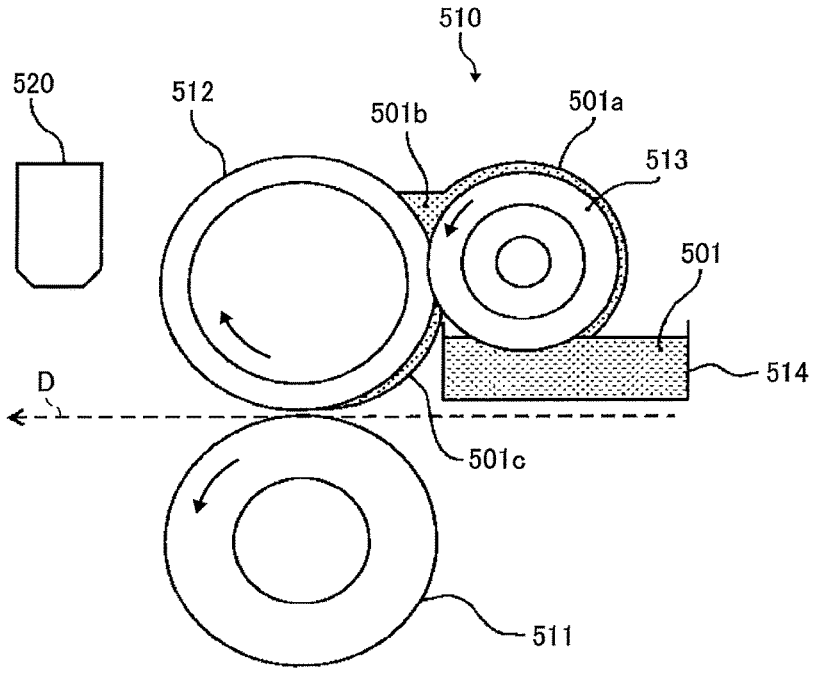
FIG. 17 is a schematic view of an example of the inkjet recording apparatus in which an exposure light source is disposed downstream from the application device in the sheet conveyance direction.

In the present variation, as illustrated in FIG. 17, an exposure light source 520 as exposure device to emit active energy rays, such as ultraviolet rays, may be disposed downstream from the application device 510 in the sheet conveyance direction D. Accordingly, after the treatment liquid 501 is applied to the sheet P, the treatment liquid 501 are irradiated with the active energy rays and are partially cured (semi-cured). Then, the treatment liquid 501 is dried in the drying unit 300'. The present variation is particularly effective in a case in which the treatment liquid 501 contains a photo-polymerization initiator and has a relatively high content of moisture.

In such a case, the treatment liquid 501 preferably contains a photo-polymerization initiator. The photo-polymerization initiator is preferably a photo-radical polymerization initiator. Examples of the photo-polymerization initiator include, but are not limited to, aromatic ketones, phosphine oxide compounds, aromatic onium salt compounds, organic peroxides, thio compounds, hexaaryl biimidazole compounds, ketoxime ester compounds, borate compounds, azinium compounds, metallocene compounds, active ester compounds, carbon-halogen-bond-containing compounds, and alkylamine compounds.

Examples of the active energy ray include, but are not limited to, ultraviolet ray, visible light, α-ray, γ-ray, X-ray, and electron ray. Examples of the exposure light source 520 to emit the active energy ray include, but are not limited to, a mercury lamp, a metal halide lamp, a light emitting diode, and a laser diode.

Figure 18:
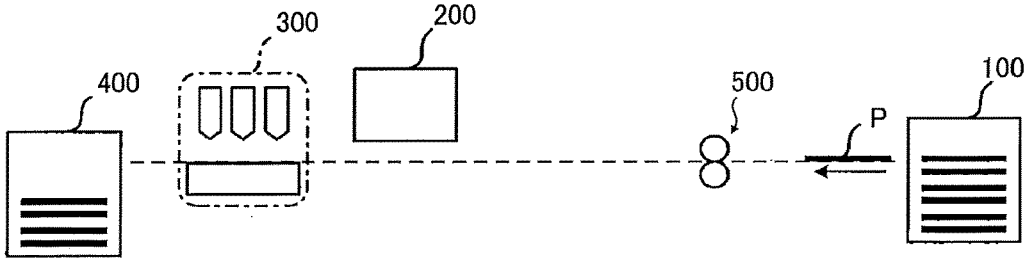
FIG. 18 is a schematic view of an example of the inkjet recording apparatus in which the drying unit is not disposed between a pre-processing unit and an image forming unit.

In the present variation, the drying unit 300' is disposed between the pre-processing unit 500 and the image forming unit 200. The sheet P applied with the treatment liquid 501 by the application device 510 of the pre-processing unit 500 is dried before ink is discharged to form an image in the image forming unit 200. However, the arrangement is not limited to the example of the present variation. For example, as illustrated in FIG. 18, no drying unit may be disposed between the pre-processing unit 500 and the image forming unit 200. The drying unit 300 disposed downstream from the image forming unit 200 in the sheet conveyance direction D may collectively dry the treatment liquid 501 applied by the application device 510 of the pre-processing unit 500 and ink discharged by the image forming unit 200. Note that, in a case in which the treatment liquid 501 containing a photo-polymerization initiator is used, the exposure light source 520 illustrated in FIG. 17 may be disposed between the image forming unit 200 and the drying unit 300.

The above-described embodiments are limited examples, and the present disclosure includes, for example, the following aspects having advantageous effects.

Aspect A

A conveying device, such as the drying unit 300, includes a blower, such as the blowing fan 311, to blow air toward a sheet material, such as the sheet P, and a conveyor, such as the conveyance assembly 302, to convey the sheet material through a blowing region blown by the blower. The conveying device further includes a wind-permeable sheet material supporter, such as the support wires 325 or the meshed belt 328 or 328', to support a center region, such as the center region P1, of the sheet material from a back side of a blown surface of the sheet material. The conveyor conveys the sheet material while sandwiching an end region, such as the end region P2, of the sheet material in a sheet-material width direction perpendicular to a sheet-material conveyance direction in which the sheet material is conveyed. According to the present aspect, the end region in the sheet-material width direction of the sheet material, which is supported from the back side by the wind-permeable sheet material supporter, is sandwiched. Accordingly, even if a wind hitting the blown surface of the sheet material and a wind passing through the sheet material supporter hit each other and cause a turbulence of air flow, such a configuration can reduce the fluttering of an edge of the sheet material, thus allowing stable sheet conveyance.

Aspect B

In the above-described aspect A, the conveyor conveys the sheet material with movement of the surface of the surface movable member while sandwiching the end region P2 with a surface movable member, such as the conveyance belts 321A and 321B or the meshed belt 328', and a presser, such as the end pressing belts 331A and 331B. According to aspect B, the sheet material can be conveyed using the configuration of sandwiching the end region of the sheet material.

Aspect C

In the above-described aspect B, the presser is movable at the same speed as the moving speed of the surface movable member. The present aspect can reduce slippage of the sheet material sandwiched between the surface movable member and the presser, thus reducing the meandering of the sheet material or scratches on the sheet material.

Aspect D

In any of the above-described aspects A to C, the sheet material supporter is a meshed belt, such as the meshed belt 328'. If the sheet material supporter is a windproof member, a wind from the blower hits the sheet material supporter before the sheet material enters the blowing region, an air flow moving along the sheet material supporter would occur. Such an air flow might go toward the leading end of the sheet material conveyed from an upstream side in the sheet-material conveyance direction, thus causing the fluttering of the leading end of the sheet material and a conveyance failure. By contrast, when the sheet material supporter is a wind-permeable member, at least a portion of a wind from the blower can pass the sheet material supporter, thus reducing the strength of the air flow going toward the leading end of the sheet material along the sheet material supporter. Thus, the fluttering of the leading end of the sheet material can be reduced, thus allowing stable sheet conveyance. According to the present aspect, the occupancy area of the sheet material supporter can be reduced or the gaps through which the wind from the blower pass can be increased. Such a configuration can highly effectively reduce the strength of the air flow toward the leading end of the sheet material and the fluttering of the center region, such as the center region P1, in the width direction of the leading end of the sheet material.

Aspect E

In any of the above-described aspects A to C, the sheet material supporter includes a linear member, such as a wire or a mesh. If the sheet material supporter is a windproof member, a wind from the blower hits the sheet material supporter before the sheet material enters the blowing region, an air flow moving along the sheet material supporter would occur. Such an air flow might go toward the leading end of the sheet material conveyed from an upstream side in the sheet-material conveyance direction, thus causing the fluttering of the leading end of the sheet material and a conveyance failure. By contrast, when the sheet material supporter is a wind-permeable member, at least a portion of a wind from the blower can pass the sheet material supporter, thus reducing the strength of the air flow going toward the leading end of the sheet material along the sheet material supporter. Thus, the fluttering of the leading end of the sheet material can be reduced, thus allowing stable sheet conveyance. According to the present aspect, the occupancy area of the sheet material supporter can be reduced or the gaps through which the wind from the blower pass can be increased. Such a configuration can highly effectively reduce the strength of the air flow toward the leading end of the sheet material and the fluttering of the center region, such as the center region P1, in the width direction of the leading end of the sheet material.

Aspect F

In any of the above-described aspects A to C, the sheet material supporter is a porous belt in which multiple through-holes are formed. If the sheet material supporter is a windproof member, a wind from the blower hits the sheet material supporter before the sheet material enters the blowing region, an air flow moving along the sheet material supporter would occur. Such an air flow might go toward the leading end of the sheet material conveyed from an upstream side in the sheet-material conveyance direction, thus causing the fluttering of the leading end of the sheet material and a conveyance failure. By contrast, when the sheet material supporter is a wind-permeable member, at least a portion of a wind from the blower can pass the sheet material supporter, thus reducing the strength of the air flow going toward the leading end of the sheet material along the sheet material supporter. Thus, the fluttering of the leading end of the sheet material can be reduced, thus allowing stable sheet conveyance. According to the present aspect, the occupancy area of the sheet material supporter can be reduced or the gaps through which the wind from the blower pass can be increased. Such a configuration can highly effectively reduce the strength of the air flow toward the leading end of the sheet material and the fluttering of the center region, such as the center region P1, in the width direction of the leading end of the sheet material.

Aspect G

In any one of the aspects A to F, the sheet material supporter is movable in the sheet-material conveyance direction. Such a configuration can reduce the conveyance resistance due to a contact of the sheet material supporter with the back side of the sheet material, thus allowing more stable conveyance performance.

Aspect H

According to any one of the above-described aspects A to G, the position of the sheet material supporter in the normal direction of the blown surface of the sheet material is disposed further away from the blower than a sandwiching position at which the end region is sandwiched. With such a configuration, in a situation in which the sheet material is not deviated at the sandwiching position by a wind from the blower, the sheet material supporter does not contact the back side of the sheet material, thus allowing a reduction in conveyance resistance and more stable conveyance performance. With such a configuration, even if the sheet material is deviated at the sandwiching position by a wind from the blower, the sheet material supporter supports the back side of the sheet material, thus reducing conveyance failure.

Aspect I

A printing apparatus, such as the inkjet recording apparatus 1, includes a liquid discharger, such as the liquid discharge heads 220C, 220M, 220Y and 220K, to discharge liquid, such as ink, onto a sheet material, such as the sheet P, and the conveying device according to any one of the above-described aspects A to H, such as the drying unit 300, to blow air toward and convey the sheet material to which the liquid discharged by the liquid discharger has adhered. According to aspect I, a printing apparatus can be provided that is capable of performing stable sheet conveyance in a conveying device.

Aspect J

A printing apparatus, such as the inkjet recording apparatus 1, includes a liquid discharger, such as the liquid discharge heads 220C, 220M, 220Y and 220K, to discharge liquid, such as ink, to a sheet material, such as the sheet P, a pre-processing unit, such as the application device 510, disposed upstream from the liquid discharger in the sheet-material conveyance direction to apply a treatment liquid, such as the treatment liquid 501, to the sheet material before the liquid is discharged, and the conveying device, such as the drying unit 300, according to any one of the above-described aspects A to H disposed on the upstream side of the liquid discharger in the sheet-material conveyance direction, to blow air toward and convey the sheet material to which the treatment liquid has been applied by the pre-processing unit. According to aspect J, a printing apparatus can be provided that is capable of performing stable sheet conveyance in a conveying device.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A conveying device comprising:

a blower to blow air toward a sheet material;

a conveyor to convey the sheet material through a blowing region blown by the blower; and a chamber that includes an entrance and an exit of the sheet material and a wall surrounding the blowing region, the conveyor including:

a sheet material supporter to support a center region of the sheet material from a back side of a blown surface of the sheet material, the sheet material supporter being made of linear structures or a meshed structure;

a conveyance belt to support an end region of the sheet material in a direction perpendicular to a sheet-material conveyance direction in which the sheet material is conveyed by the conveyor; and a pressing belt to press the end region of the sheet material against the conveyance belt, the pressing belt spanning an inside and an outside of the chamber, to press the end region of the sheet material against the conveyance belt in at least the inside of the chamber.

2. The conveying device according to claim 1 wherein the pressing belt is movable at a same speed as a speed of movement of the conveyance belt.

3. The conveying device according to claim 1, wherein the sheet material supporter includes a plurality of wires spaced away from each other.

4. The conveying device according to claim 1, wherein the sheet material supporter is movable in the sheet-material conveyance direction.

5. The conveying device according to claim 1, wherein a position of the sheet material supporter is disposed further away from the blower than the conveyance belt.

6. A printing apparatus comprising:

a liquid discharger to discharge liquid onto the sheet material; and the conveying device according to claim 1 to blow air toward and convey the sheet material to which the liquid discharged by the liquid discharger has adhered.

7. A printing, apparatus comprising:

a liquid discharger to discharge liquid to the sheet material;

a pre-processing unit disposed upstream from the liquid discharger in the sheet-material conveyance direction, to apply a treatment liquid to the sheet material before the liquid is discharged; and the conveying device according to claim 1 to blow air toward and convey the sheet material to which the treatment liquid is applied by the pre-processing unit.

* * * * *